US005429036A

United States Patent [19]

Latos

[11] Patent Number: 5,429,036

[45] Date of Patent: Jul. 4, 1995

[54] REMOTE HYDRAULIC PRESSURE INTENSIFIER

[75] Inventor: Gordon D. Latos, Calgary, Canada

[73] Assignee: Nowsco Well Service Ltd., Canada

[21] Appl. No.: 184,767

[22] Filed: Jan. 21, 1994

Related U.S. Application Data

[63] Continuation of Ser. No. 912,445, Jul. 13, 1992, abandoned.

[51] Int. Cl.[6] ..... F01B 7/04; F01B 31/00

[52] U.S. Cl. ..... 91/181; 91/183; 92/181 P; 60/533; 60/327; 60/372

[58] Field of Search ..... 60/533, 584, 547.1, 60/560, 574, 578, 581, 372, 327; 91/166, 167 R, 177, 179, 181, 183, 187, 422; 92/67, 181 R, 181 P, 183; 417/392, 398, 399, 400, 401

[56] References Cited

U.S. PATENT DOCUMENTS

| | | | |
|---|---|---|---|
| 2,293,076 | 8/1942 | Ponting | 103/49 |
| 2,687,694 | 8/1951 | Conrad | 103/52 |
| 3,112,800 | 12/1963 | Bobo | 175/67 |
| 3,587,407 | 6/1971 | Wilson | 91/422 X |
| 3,809,502 | 5/1974 | Henry | 417/225 |
| 3,901,559 | 8/1975 | Inada | 303/21 F |
| 3,945,207 | 3/1976 | Hyatt | 60/416 |
| 3,952,516 | 4/1976 | Lapp | 60/477 |
| 4,047,581 | 9/1977 | Erickson | 175/95 |
| 4,202,656 | 5/1980 | Roeder | 417/88 |
| 4,271,671 | 6/1981 | Smeets | 60/578 |
| 4,328,671 | 5/1982 | Pattison | 60/578 X |
| 4,458,766 | 7/1984 | Siegel | 175/25 |
| 4,512,151 | 4/1985 | Yamatani | 60/581 |
| 4,535,429 | 8/1985 | Russell et al. | 367/85 |
| 4,618,123 | 10/1986 | Bilharz et al. | 251/28 |
| 4,705,069 | 11/1987 | Fertig | 137/596 |
| 4,762,473 | 8/1988 | Tieben | 60/372 X |
| 4,820,136 | 4/1989 | Saurwein | 417/397 |

FOREIGN PATENT DOCUMENTS

| | | | |
|---|---|---|---|
| 1752720 | 9/1991 | Germany . | |
| 8402557 | 7/1984 | WIPO | 60/578 |
| 9107566 | 5/1991 | WIPO . | |

*Primary Examiner*—Thomas E. Denion
*Assistant Examiner*—Hoang Nguyen
*Attorney, Agent, or Firm*—Skjerven, Morrill, MacPherson, Franklin & Friel; Norman R. Klivans

[57] ABSTRACT

A double acting reciprocating intensifier uses a single low pressure fluid stream as both the power supply and the source of fluid the pressure of which is to be intensified. The entire device, including flow paths, is confined within a compact cylindrical housing. Tandem drive pistons minimize operating frequency, while maximizing intensification ratio and output volume flowrate. Placement of both high pressure cylinders downstream of the drive cylinders permits simple routing of flows through the centers of the low and high pressure pistons. A check valve connected between the high pressure pistons eliminates one of the four high pressure check valves required in the prior art. A single reciprocating valve, whose state is determined by drive and high pressure piston position, coordinates all of the drive side flows. Various components perform multiple functions to permit the compact shape.

23 Claims, 3 Drawing Sheets

REMOTE HYDRAULIC PRESSURE INTENSIFIER

This application is a continuation of application Ser. No. 07/912,445, filed Jul. 13, 1992 (now abandoned).

BACKGROUND OF THE INVENTION

1. Field of the Invention

This invention relates to a device for intensifying pressure of a flowing fluid, and more specifically to a double acting reciprocating intensifier where a single low pressure fluid stream serves as both the power supply and the source of the fluid to be intensified.

2. Description of the Prior Art

Many applications require high pressure fluids at locations remote from high pressure pumping equipment. Pumping fluids to remote locations is commonplace at moderate pressures. However, cost increases dramatically with pressure and remoteness. An alternative approach is to pump moderate pressure to an intensifier which develops the required higher pressure at the site of the application.

Patent disclosures for pressure intensifiers (some of them for downhole and other remote applications) date back a number of years (See U.S. Pat. Nos. 2,293,076, 3,809,502, 3,952,516, 4,047,581, 4,820,136). However, downhole and other remote intensifiers have not come into common use. Other patent disclosures (U.S. Pat. Nos. 3,112,800, 3,901,559, 3,945,207, 4,202,656, 4,458,766, 4,535,429, 4,618,12, 4,705,069) employ the principle of fluid pressure intensification or other relevant principles.

The following examples illustrate specific problems, previous solutions and illustrate the advantages of a remote intensifier. Both problems happen to be downhole. However, other remote applications would benefit similarly from availability of a remote intensifier.

Application 1: DOWNHOLE JETTING

Problem

Petroleum producing and injection wells, and geothermal wells frequently suffer partial plugging from chemical solids that precipitate onto the walls of the well. The extra pressure drop associated with these blockages can significantly affect the efficiency and economics of well operation. Petroleum wells may also suffer accumulations of petroleum solids, such as tars and waxes, that precipitate from the production flow during ascent to the surface. These blockages frequently prevent the passage of tools commonly used in production and workover operations.

Prior Art Solutions

Acids or other solvents are sometimes used to remove downhole deposits. But since there is no practical method for evaluating the completeness of deposit removal during chemical washout, the job may be terminated before removal is complete. Also, small differences in deposit chemistry can cause local variations in the rate of dissolution, thus increasing the risk of incomplete removal. Finally, at least in the petroleum industry, there is a growing reluctance to use chemical solvents because of environmental concerns, and because of the risk of damage to producing formations.

Mechanical methods are also used with varying success. When properly applied, water jets of moderate pressure (2000 to 5000 psi) can remove petroleum deposits and soft chemical scales quickly enough to be economic. However, the rate of removal for hard chemical scales is far too low. To complicate the matter further, the thickness, location and hardness of scale buildup can never be accurately determined in advance. Fine abrasive particles can be suspended in the water to significantly enhance jetting performance. However, abrasive jets also cut metal. The difficulty of accurately controlling the location of a remote jetting tool generally makes the risk of accidental damage to equipment in the vicinity of the jet unacceptable.

Harder chemical scales can be drilled out of well bores with a high degree of success. However, there are several disadvantages to this technique. Only material directly in the path of the drill bit is removed; side pocket mandrels and other irregularities in the internal shape of the well completion are not cleaned out. Also, the drill can cause serious damage to other downhole equipment if it wanders off course. Finally, at the elevated temperatures typically found downhole, positive displacement downhole drilling motors can be expensive to maintain, and have certain fluid compatibility limitations.

A downhole intensifier if available would enhance water jetting performance sufficiently to eliminate the need for abrasives and chemical solvents, and could clean out irregularly shaped areas without damaging metal components at the jetting site.

Application 2: Deep Well Drilling

The rate of progress for rock bit drilling of petroleum and other deep wells can be significantly enhanced when properly assisted by an ultra-high pressure jet (greater than 30,000 psi) of drilling mud or water. The potential economic benefits are substantial.

The only practical prior art method for delivering high pressure fluid to the drill bit is an expensive system comprising high pressure pumps at surface and a drill string with concentric passages for low and high pressure flows. The drill string is specially manufactured at considerable cost premium due to the high pressure seals and manufacturing precision required for leak-tight joints. The concentric passages increase overall pumping energy losses by significantly increasing the surface area of fluid to metal contact. Separate pumping systems are required for the two flows.

A downhole pressure intensifier if available would elevate a fraction of the drilling fluid flow to jetting pressure locally at the drill bit. The balance of flow would circulate normally to transport rock cuttings to the surface. Fluid volume flow rates and pressures could be controlled conventionally. The intensifier would be supplied by a conventional drilling fluid pump and drill string, and its capital cost would be a small fraction of that for the system pumping two pressures from surface.

A prior art reciprocating intensifier uses the pressure energy of one fluid stream to increase the pressure of a second fluid stream via a differential area piston which isolates them physically. Thus disadvantageously, two fluid streams must be supplied to the remote location of the intensifier. Driving fluid in contact with the large piston face compresses and displaces working fluid in contact with the small piston face. On the return stroke of the piston, drive fluid is exhausted and the small cylinder refills with working fluid in preparation for the next power stroke. The process repeats creating an intermittent stream of high pressure discharge. In practice, reciprocating intensifiers generally reduce discharge pressure fluctuation by using two piston sets placed back to back. Under this "double acting" configuration, the combined piston reciprocates as the power stroke alternates from one side to the other. U.S. Pat. No. 2,293,076 describes this process further.

SUMMARY OF THE INVENTION

A double acting intensifier in accordance with the present invention uses a single low pressure fluid stream (liquid or gas) as both the power supply and the source of fluid the pressure of which is to be intensified. This suits it ideally for remote applications where the cost of transmitting a second fluid to the worksite would be prohibitive. A cylindrical exterior shape and compact cross section enable the device to negotiate tight passages without risk of hangup or damage to itself.

Certain components perform more than one function. Low and high pressure pistons double as fluid passages. A single valve controls supply and discharge flow from all drive side pistons. Drive pistons acting in tandem may be used to permit higher intensification ratios, lower operating frequencies and/or higher output volume flowrates than an arrangement with single pistons driving in each direction. All of the fluid passages located outside of the cylindrical main housing in the prior art devices are eliminated. Placement of both high pressure cylinders below (at one end of) the drive cylinders permits simple routing of flows through the centers of the low and high pressure pistons. A check valve mounted on a high pressure piston eliminates one of the four high pressure check valves required in the prior art. A single reciprocating valve, whose state is determined by piston position, coordinates all four drive side flows. This permits a simple control mechanism for a double acting intensifier. An intensifier as small as two inches O.D. (outside diameter) is practical for applications in petroleum well completions. Maximum O.D. is limited only by the size of the smallest passage through which the unit must fit.

In some applications, such as water jetting, the return flow of working fluid carries a stream of solid debris from the work site. Because the volume flowrate of motive fluid returning from a remote intensifier is much greater than that of the working fluid, the combined flow can carry solids far more effectively than working fluid alone. Thus the intensifier enhances solids removal capability over the case where working fluid is transmitted at high pressure to the worksite.

The described embodiment is a double acting configuration with an integral pressure accumulator. The accumulator may be eliminated for applications where significant output pressure fluctuations can be tolerated.

Although practical, a single acting embodiment delivers half the volume flowrate of working fluid with relatively small savings in length, weight and complexity. The single acting embodiment also places greater demands on the function of the discharge pressure accumulator and includes a mechanism for returning the piston to the start of its power stroke.

This intensifier is a practical working device that can be constructed at diameters small enough to be used inside petroleum well completions (already drilled and producing wells). It can also be scaled up to larger diameters that would suit it for application in well drilling. Prior art downhole intensifiers were developed specifically for well drilling, either with jet-assisted rock bits or with high pressure jets alone. These prior art devices could not be practically scaled down to diameters required for work in the smaller standard sizes needed in petroleum well completions.

DETAILED DESCRIPTION OF THE PREFERRED EMBODIMENT

Figure 2:
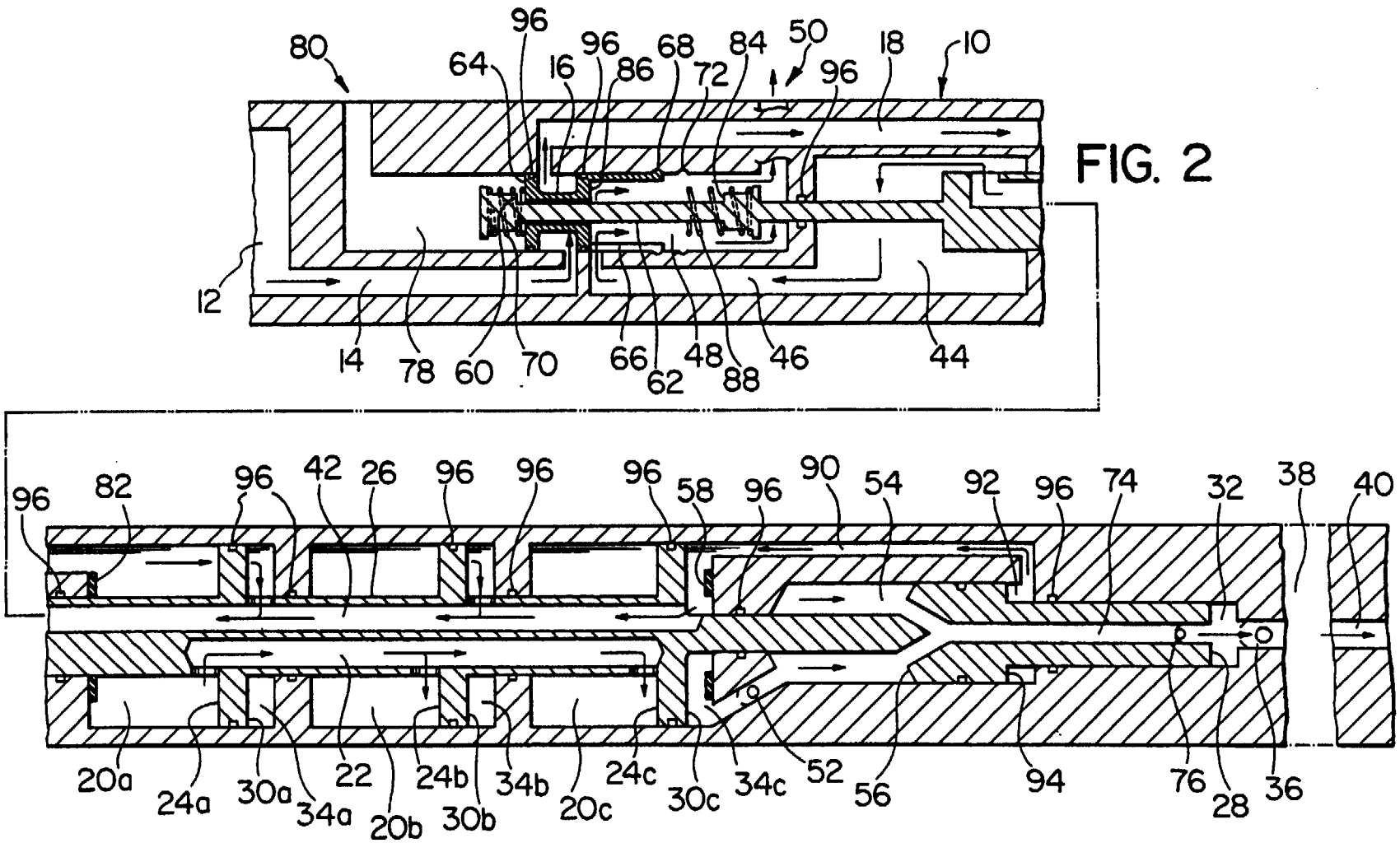
FIG. 2 is a sectional view of one embodiment of the present invention with the piston assembly being in a first relative position.

With reference to FIG. 2, fluid enters the intensifier 10 via port 12 and flows through passage 14 to valve 16 where it is directed via passage 18 to cylinder **20*a*, and from cylinder 20*a* via passage 22 to cylinders 20*b* and 20*c*. The force of this fluid against pistons 24*a*, 24*b*, and 24*c* drives the entire piston assembly 26 downward. Concurrently, pistons 28 and 30*a*, 30*b*, and 30*c* displace fluid from their respective cylinders, 32 and 34*a*, 34*b*, and 34*c*. By virtue of its smaller surface area relative to pistons 24*a*, 24*b*, and 24*c* combined, piston 28 compresses the fluid in cylinder 32 to a pressure greater than that of the fluid in cylinders 20*a*, 20*b*, and 20*c*. Piston 28 displaces this high pressure fluid through check valve 36 and pressure accumulator 38 before it is discharged from the intensifier 10 via port 40 en route to the working fluid end use point. Meanwhile, fluid being displaced from cylinders 34*a*, 34*b* and 34*c* by pistons 30*a*, 30*b* and 30*c* flows through passage 42 in piston assembly 26, chamber 44 and passage 46 into chamber 48. From there, it is exhausted from intensifier 10 via port 50. Some of the fluid leaving cylinder 34*c* flows through check valve 52 and into cylinder 54 where it fills the void being formed by the withdrawal of piston 56. As the piston assembly 26 approaches safety stop 58 at the bottom of its stroke, shoulder 60 on valve actuator rod 62 contacts shoulder 64 on valve 16 causing latches 66 to disengage from groove 68. Spring 70 pushes valve 16 far enough for latches 66 to engage groove 72, thus reversing the direction of flows to and from cylinders 20*a*, 20*b* and 20*c* and 34*a*, 34*b* and 34*c***.

Figure 3:
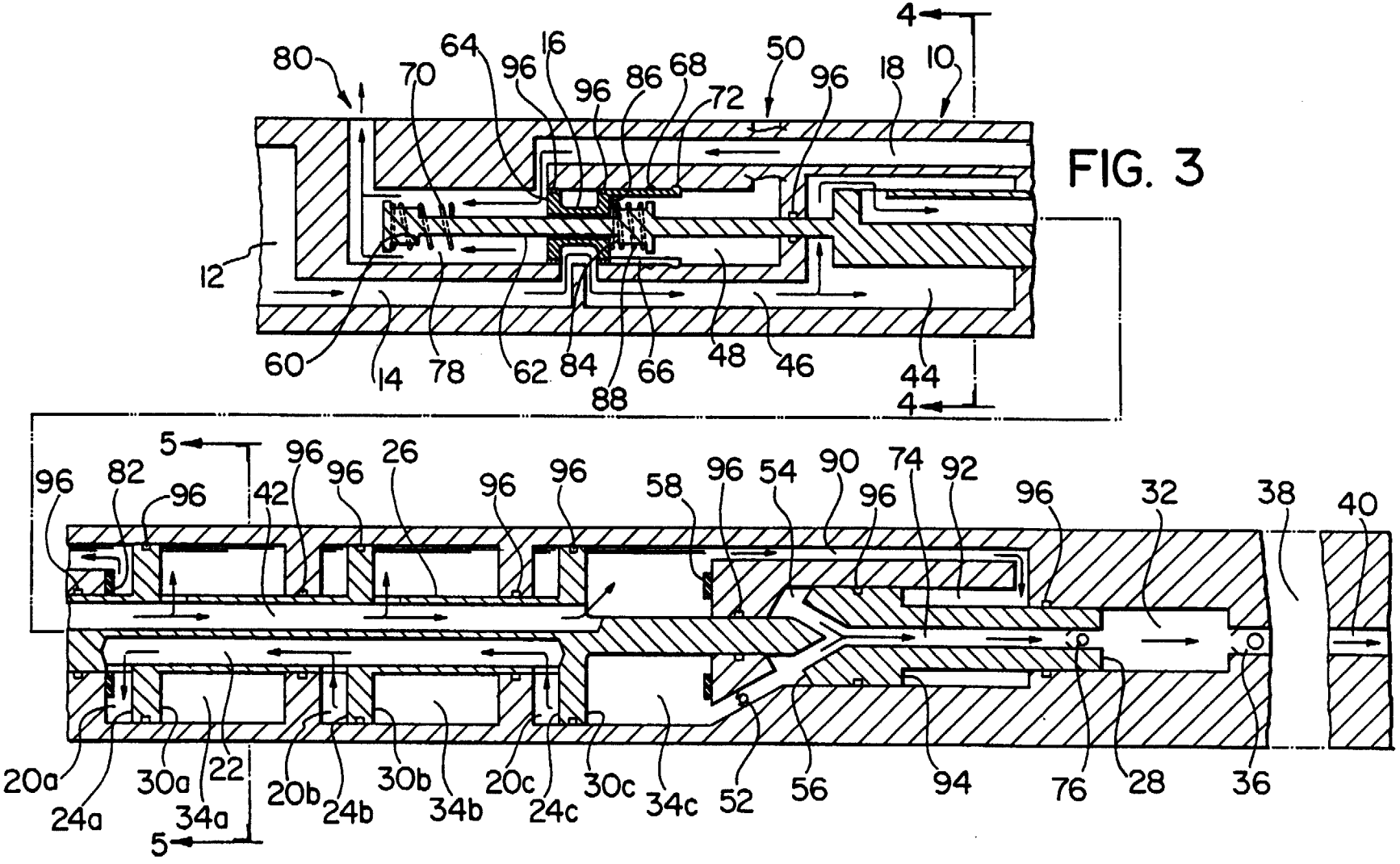
FIG. 3 is a sectional view of the device of FIG. 2 with the piston assembly being in a second relative position.

With reference to FIG. 3 showing the identical intensifier of FIG. 2 with the piston assembly 26 moved to its further most opposite position and valve 16 correspondingly in its opposite position, fluid entering the intensifier 10 via port 12 flows through passage 14 to valve 16 which now directs it via passage 46, chamber 44 and passage 42 to cylinders **34*a*, 34*b* and 34*c*. The force of this fluid against pistons 30*a*, 30*b* and 30*c* drives the entire piston assembly 26 upward. Concurrently, pistons 56 and 24*a*, 24*b* and 24*c* displace fluid from their respective cylinders 54 and 20*a*, 20*b* and 20*c*. By virtue of its smaller surface area relative to pistons 30*a*, 30*b* and 30*c* combined, piston 56 compresses the fluid in cylinder 54 to a pressure greater than that of the fluid in cylinders 34*a*, 34*b* and 34*c*. High pressure fluid displaced by piston 56 leaves cylinder 54 via passage 74, flowing through check valve 76 and into cylinder 32. A portion of this fluid fills the void being formed by the withdrawal of piston 28. The balance passes through check valve 36 and pressure accumulator 38 before being discharged from the intensifier 10 via port 40 en route to the working fluid end use point. Check valves 36, 52, 76 may be of any type; in one embodiment they are "disk" check valves supplied by Waterjet Corp. Meanwhile, fluid being displaced from cylinders 20b and 20c by pistons 24b and 24c flows through passage 22 to cylinder 20a where it joins fluid being discharged via passage 18. The combined flow passes through chamber 78 and is exhausted from intensifier 10 via port 80. As the piston assembly 26 approaches safety stop 82 at the top of its stroke, shoulder 84 on valve actuator rod 62 contacts shoulder 86 on valve 16 causing latches 66 to disengage groove 72. Spring 88 pushes valve 16 far enough for latches 66 to engage groove 68, The flows to cylinders 20a, 20b and 20c and 34a, 34b and 34c** resume their original directions and the cycle is thus completed.

Passage 90 maintains constant communication between chamber 92 and cylinder 34c, thus avoiding a trapped volume below piston 56. When piston 30c is on its power stroke, piston 94 provides a small additional force to drive the piston assembly 26.

The combined face areas of pistons 24a, 24b and 24c and 30a, 30b and 30c are proportioned to the face areas of pistons 28 and 56, respectively, so that the intensification ratio is almost equal in both directions of piston travel. This embodiment has three sets of drive pistons connected in tandem. However, any suitable number of drive pistons could be used depending on the desired intensification ratio, output volume flow rate and reciprocation frequency.

Figure 4:
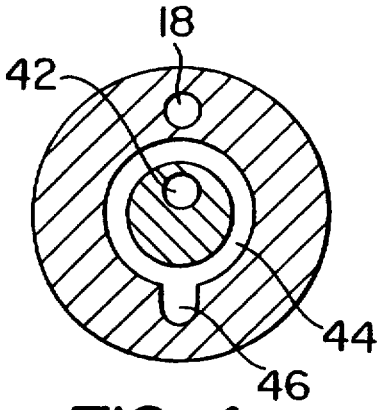
FIG. 4 is a sectional view of FIG. 3 illustrating the arrangement of flow paths to the drive cylinders.
Figure 5:
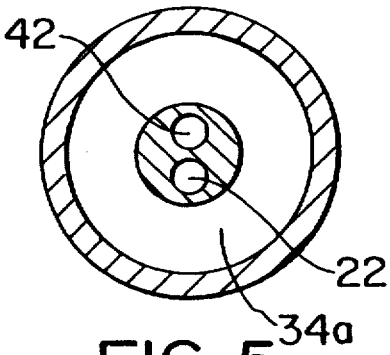
FIG. 5 is a sectional view of FIG. 3 illustrating the arrangement of components in a drive cylinder.

FIGS. 4 and 5 are cross-sections through the intensifier 10 of FIG. 3 as indicated on FIG. 3 showing respectively the arrangement of flow paths 18, 42, 46 to the drive cylinders and the arrangement of components in a drive cylinder 34a.

FIGS. 2 and 3 illustrate a number of seals 96 for isolating fluid bodies of differing pressures. The exact seal locations illustrated are not crucial to the proper function of the device. These seals may be constructed of any materials and design suitable for the pressure, speed, and temperature characteristics of the application. Typically these seals are teflon or other polymers energized with elastomers and/or metal springs.

Figure 1:
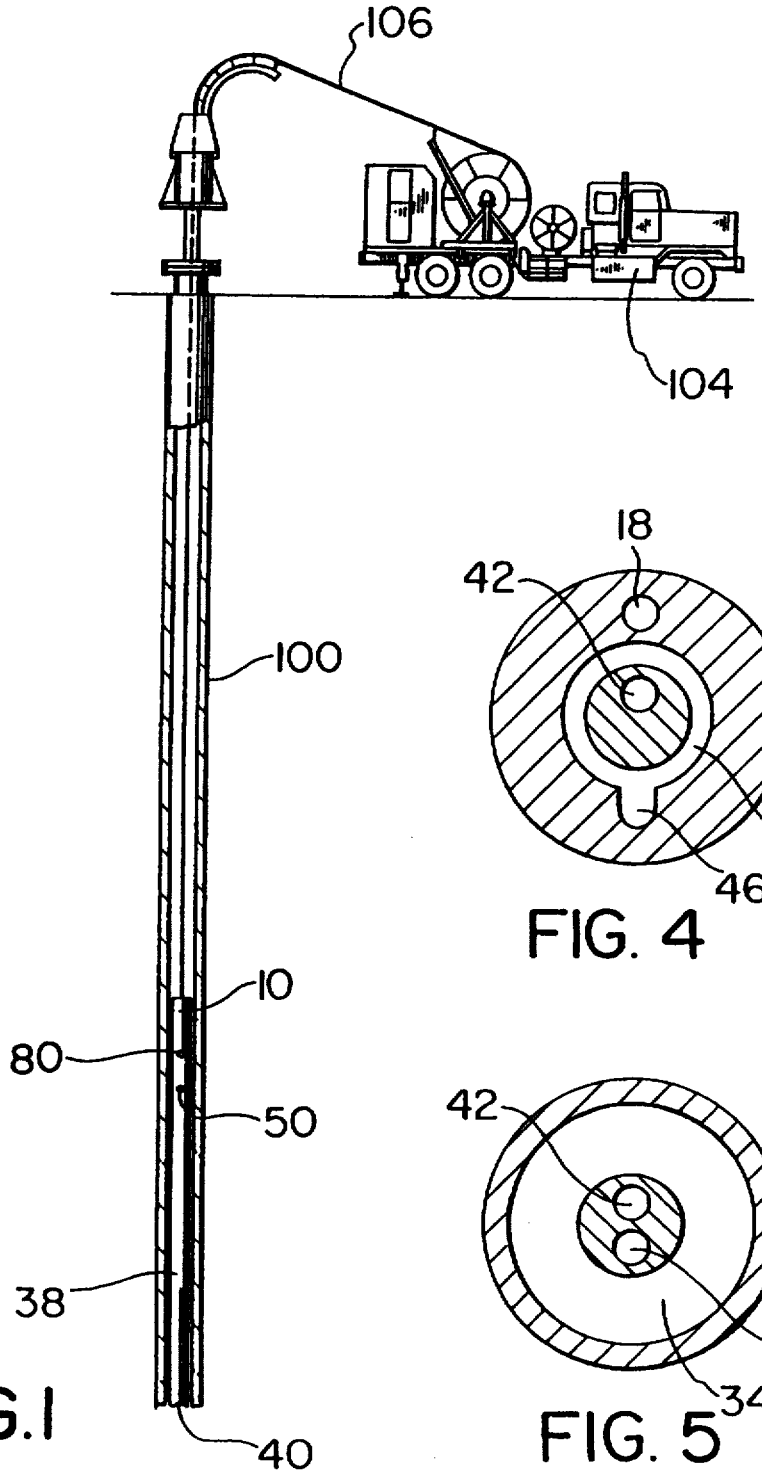
FIG. 1 illustrates the intensifier assembly for scale jetting in accordance with the present invention as it appears in a completed petroleum well.

FIG. 1 shows intensifier 10 used for scale jetting in a completed petroleum well 100. Elements 38, 40, 50, and 78 are as in FIGS. 2 and 3. Also shown are truck 104 for carrying piping (coiled tubing) 106 to supply fluid to intensifier 10.

A specific system involving latches 66 and grooves 68, 72 is described above for retaining flow control valve 16 at each of its working positions. However, any suitable mechanism could be used to perform this function. An alternative for the above described reciprocating control valve for instance would be a rotary four way valve. If included, pressure accumulator 38 may be constructed in any suitable manner. For example, this may be a bladder or piston type device. For water the intensifier device is made of stainless steel or other non-corroding metals. For non-corrosive liquids or gases, it is of steel or other high strength metals.

Working fluid discharge pressure depends on what the application requires, and supply pressure depends on what it is practical to deliver; there is a trade off between supply pressure and volume flowrate. Working pressure discharge volume flowrate depends on supply conditions and the intensifier diameter in accordance with the application. For downhole oil field tools run on coiled tubing, supply pressure is typically 2000 to 5000 psi (pounds per square inch) and supply volume flowrate is about 1 barrel/minute. Intensifiers in the 2 to 3 inch (or under 4 inches) outside diameter range would produce output pressure and volume flowrate ranges of 10,000 to 100,000 psi and flow rates of 10 to 1 gallons per minute. Thus the pressure intensifier ratio is in the range of 5:1 to 20:1.

This disclosure is illustrative and not limiting; other modifications will be apparent to one skilled in the art in the light of this disclosure and the appended claims.

I claim:

1. A reciprocating fluid pressure intensifier comprising:

a housing;

an entry port near a first end of the housing for a fluid to enter at a low pressure;

a control valve in the housing switchable between a first and second positions for admitting the fluid from the entry port into a first passage when the control valve is at the first position;

an actuator operatively connected to the control valve;

a first plurality of drive cylinders in the housing each in communication with the first passage and each having a drive piston located therein, each drive piston being connected to the control valve actuator;

a first high pressure cylinder in the housing and having a first high pressure piston connected to the control valve actuator and located in the first high pressure cylinder, a working surface area of the first high pressure piston being less than that of a total working surface area of the first plurality of drive pistons;

a second passage in communication with the first high pressure cylinder for admitting the fluid into the first high pressure cylinder when the control valve is at the first position; and a first exit port near a second end of the housing and in communication with the first high pressure cylinder for providing a high pressure flow of the fluid out of the intensifier, whereby the fluid entering the entry port is both a source of power for operating the intensifier and a source of the fluid exiting the exit port.

2. The device of claim 1, wherein the housing is cylindrical and all portions of the device are within the housing.

3. The device of claim 1, wherein the first high pressure cylinder is located nearer the first exit port than are the first plurality of drive cylinders.

4. The device of claim 1, wherein the control valve is a reciprocating valve connected by the control valve actuator to each of the first plurality of drive pistons and to the first high pressure piston.

5. The device of claim 4, wherein the position of the control valve is determined by a position of each of the plurality of drive pistons and the first high pressure piston.

6. The device of claim 1, further comprising a one way valve connected between the first high pressure cylinder and the exit port.

7. The device of claim 1, further comprising a pressure accumulator connected between the first high pressure cylinder and the exit port.

8. The device of claim 1, wherein a portion of the first passage is defined by each of the drive pistons.

9. The device of claim 1, further comprising a second exit port located near the first end of the housing and in communication with each of the drive cylinders for low pressure discharge of the fluid when the fluid is spent as a drive fluid.

10. The device of claim 1, further comprising:

a second plurality of drive cylinders in the housing each having a drive piston located therein, and operating reciprocally to the drive pistons located in the first plurality of drive cylinders; and a second high pressure cylinder in the housing having a second high pressure piston located therein, and operating reciprocally to the first high pressure piston, whereby the intensifier is a reciprocating double acting device.

11. The device of claim 10, further comprising an additional passage communicating between the first and second high pressure cylinders, wherein at least a portion of the additional passage is defined by the second high pressure piston.

12. The device of claim 10, wherein a second one-way valve is mounted in the first high pressure cylinder for regulating flow of the fluid between the first and second high pressure cylinders.

13. The device of claim 10, wherein the second high pressure cylinder is located nearer the exit port than any of the drive cylinders.

14. A reciprocating fluid pressure intensifier comprising:

a housing;

an entry port near a first end of the housing for a fluid to enter at a low pressure;

a reciprocating valve for admitting the fluid from the entry port into one of two paths;

an actuator operatively connected to the valve;

a plurality of drive cylinders in the housing, each having a drive piston located therein, each drive piston being connected to the actuator;

a high pressure cylinder in the housing having a high pressure piston located therein and the high pressure piston being connected to the actuator, the high pressure piston having a working surface area less than that of a total working surface area of the plurality of drive pistons;

a first exit port near the second end of the housing and in communication with the high pressure cylinder, for providing a high pressure flow of the fluid out of the intensifier; and means for guiding the fluid to flow under control of the valve from the entry port alternatively through the two paths into drive cylinders, and the high pressure cylinder to cause the drive pistons and high pressure piston to reciprocate.

15. The device of claim 14, further comprising a second exit port near the first end of the housing and in communication with each of the plurality of drive cylinders for providing a low pressure flow of the fluid out of the intensifier, whereby the low pressure fluid is a spent drive fluid.

16. A reciprocating fluid pressure intensifier comprising:

a housing;

an entry port near a first end of the housing for a fluid to enter at a low pressure;

a control valve in the housing for admitting the fluid from the entry port into a first passage;

an actuator operatively connected to the control valve;

a first plurality of drive cylinders in the housing each in communication with the first passage and each having a drive piston located therein, each drive piston being connected to the control valve actuator;

a first high pressure cylinder in the housing and having a first high pressure piston connected to the control valve actuator and located in the first high pressure cylinder, a working surface area of the first high pressure piston being less than that of a total working surface area of the first plurality of drive pistons;

a second passage in communication with the first high pressure cylinder for admitting the fluid into the first high pressure cylinder only when the control valve is in a predetermined position;

a first exit port near a second end of the housing and in communication with the first high pressure cylinder for providing a high pressure flow of the fluid out of the intensifier, whereby the fluid entering the entry port is both a source of power for operating the intensifier and a source of the fluid exiting the exit port; and a pressure accumulator connected between the first high pressure cylinder and the exit port.

17. A reciprocating fluid pressure intensifier comprising:

a housing;

an entry port near a first end of the housing for a fluid to enter at a low pressure;

a control valve in the housing for admitting the fluid from the entry port into a first passage;

an actuator operatively connected to the control valve;

a first plurality of drive cylinders in the housing each in communication with the first passage and each having a drive piston located therein, each drive piston being connected to the control valve actuator;

a first high pressure cylinder in the housing and having a first high pressure piston connected to the control valve actuator and located in the first high pressure cylinder, a working surface area of the first high pressure piston being less than that of a total working surface area of the first plurality of drive pistons;

a second passage in communication with the first high pressure cylinder for admitting the fluid into the first high pressure cylinder only when the control valve is in a predetermined position;

a first exit port near a second end of the housing and in communication with the first high pressure cylinder for providing a high pressure flow of the fluid out of the intensifier, whereby the fluid entering the entry port is both a source of power for operating the intensifier and a source of the fluid exiting the exit port; and a second exit port located near the first end of the housing and in communication with each of the drive cylinders for low pressure discharge of the fluid when the fluid is spent as a drive fluid.

18. A reciprocating fluid pressure intensifier comprising:

a housing;

an entry port near a first end of the housing for a fluid to enter at a low pressure;

a control valve in the housing for admitting the fluid from the entry port into a first passage;

an actuator operatively connected to the control valve;

a first plurality of drive cylinders in the housing each in communication with the first passage and each having a drive piston located therein, each drive piston being connected to the control valve actuator;

a first high pressure cylinder in the housing and having a first high pressure piston connected to the control valve actuator and located in the first high pressure cylinder, a working surface area of the first high pressure piston being less than that of a total working surface area of the first plurality of drive pistons;

a second passage in communication with the first high pressure cylinder for admitting the fluid into the first high pressure cylinder only when the control valve is in a predetermined position;

a first exit port near a second end of the housing and in communication with the first high pressure cylinder for providing a high pressure flow of the fluid out of the intensifier, whereby the fluid entering the entry port is both a source of power for operating the intensifier and a source of the fluid exiting the exit port; and a second plurality of drive cylinders in the housing each having a drive piston located therein and operating reciprocally to the drive pistons located in the first plurality of drive cylinders; and a second high pressure cylinder in the housing having a second high pressure piston located therein and operating reciprocally to the first high pressure piston;

whereby the intensifier is a reciprocating double acting device.

19. The device of claim 10, wherein a passage defined by the first and second high pressure pistons directs high pressure fluid discharge from the first high pressure cylinder to the second high pressure cylinder, filling the second high pressure cylinder in preparation for a subsequent power stroke thereof and discharging a surplus portion of the high pressure fluid out of the device through the first exit port.

20. The device of claim 1, further comprising:

a length of coiled tubing connecting to the entry port, thereby providing the fluid to enter at a low pressure.

21. The device of claim 14, further comprising a length of coiled tubing connecting to the entry port, thereby providing the fluid to enter at a low pressure.

22. A method of providing a high pressure fluid flow in a completed well lined by a well casing, comprising the steps of:

providing a fluid pressure intensifier having a diameter that fits inside the well casing;

lowering the intensifier into the completed well casing on a length of coiled tubing extending to the surface of the earth;

providing a fluid through the coiled tubing to the intensifier;

increasing the pressure of the fluid in the intensifier; and expelling the pressurized fluid from the intensifier.

23. A method of providing a high pressure flow in a well bore, comprising the steps of:

providing a fluid pressure intensifier having a diameter that fits inside the well bore;

lowering the intensifier into the well bore on a length of coiled tubing extending to the surface of the earth;

providing fluid through the coiled tubing to the intensifier;

increasing the pressure of the fluid in the intensifier; and expelling the pressurized fluid from the intensifier.

* * * * *

UNITED STATES PATENT AND TRADEMARK OFFICE

CERTIFICATE OF CORRECTION

PATENT NO. : 5,429,036
DATED : July 4, 1995
INVENTOR(S) : Gordon D. Latos

It is certified that error appears in the above-identified patent and that said Letters Patent is hereby corrected as shown below:

Title page, item [54] and column 1, "REMOTE RECIPROCATING FLUID PRESSURE INTENSIFIER".

Column 1, line 30, delete "4,618,12," and insert --4,618,123--.

Signed and Sealed this

Nineteenth Day of December, 1995

Bruce Lehman

*Attest:*

BRUCE LEHMAN

*Attesting Officer*

*Commissioner of Patents and Trademarks*